US009643047B1

(12) United States Patent
Chen

(10) Patent No.: US 9,643,047 B1
(45) Date of Patent: May 9, 2017

(54) SIT-UP BENCH APPARATUS

(71) Applicant: Yi-Tzu Chen, Taoyuan (TW)

(72) Inventor: Yi-Tzu Chen, Taoyuan (TW)

( * ) Notice: Subject to any disclaimer, the term of this patent is extended or adjusted under 35 U.S.C. 154(b) by 0 days.

(21) Appl. No.: 14/946,823

(22) Filed: Nov. 20, 2015

(51) Int. Cl.
*A63B 23/00* (2006.01)
*A63B 23/02* (2006.01)

(52) U.S. Cl.
CPC ..... *A63B 23/0211* (2013.01)

(58) Field of Classification Search
USPC ..... 482/1–148
See application file for complete search history.

(56) References Cited

U.S. PATENT DOCUMENTS 5,599,261 A * 2/1997 Easley ..... A63B 21/0552 482/130
5,624,361 A * 4/1997 Lai ..... A63B 21/055 482/130
6,152,866 A * 11/2000 Kuo ..... A63B 21/055 482/130
6,565,488 B2 * 5/2003 Chen ..... A63B 21/023 482/140
6,752,745 B1 * 6/2004 Davis ..... A63B 21/00 482/129
6,966,871 B2 * 11/2005 Parmater ..... A63B 21/023 482/129
7,326,159 B2 * 2/2008 Rong ..... A63B 21/0004 482/140
2004/0067830 A1 * 4/2004 Rovere ..... A63B 23/035 482/140
2005/0181916 A1 * 8/2005 Frost ..... A63B 21/0004 482/140
2008/0076649 A1 * 3/2008 Chen ..... A47C 7/405 482/140
2008/0090709 A1 * 4/2008 Chen ..... A63B 21/045 482/140

FOREIGN PATENT DOCUMENTS

CN 203777592 U 8/2014
GB 2457747 A 8/2009
WO 2013007211 A1 1/2013

OTHER PUBLICATIONS

UK Search Report in corresponding Application No. GB1520792.1 dated Mar. 21, 2016.

* cited by examiner

*Primary Examiner* — Stephen Crow
(74) *Attorney, Agent, or Firm* — Bacon & Thomas, PLLC

(57) ABSTRACT

A sit-up bench apparatus includes a base set, two supporting rod sets, two elastic sets and an extending rod set. The base set includes a seat body and a pivotal base. The aperture is formed at one end of the pivotal base. The supporting rod set is pivotally disposed at the pivotal base and includes a supporting rod and a first cylinder. The first cylinder is connected with the supporting rod. The elastic set is disposed at the pivotal base and connected between the two supporting rod sets and the base set. The elastic set includes a spring and an extending rod set. One end of the spring is coupled to the pivotal base. The extending rod set is disposed in the aperture and includes a supporting wheel disposed at one end of the extending rod set.

10 Claims, 9 Drawing Sheets

SIT-UP BENCH APPARATUS

BACKGROUND OF THE INVENTION

1. Field of the Invention

The present invention relates to a sit-up bench apparatus, and more particularly to a sit-up bench apparatus with many different utilizations.

2. Description of Related Art

Fitness equipment is an apparatus to assist a user with exercising muscle and strengthen cardio-pulmonary function. Especially, when people live a busy life, less time and space are available for people to perform physical exercise. Since the fitness equipment is easy to operate and store, the user can perform the body exercise anytime and anywhere.

There are many different kinds of fitness equipments in the prior art, and the user can choose whatever the sports types he likes. If the user would like to perform a calf muscle exercise, the fitness equipment such as a bicycle can be chosen. If the user would like to perform arm and abdomen muscle exercise at the same time, the fitness equipment such as a rowing machine can be chosen. Therefore, according to the purpose of the muscle exercise of the user, the type of the fitness equipment can be chosen.

However, the fitness equipment in the prior art can only perform one kind of muscle exercise, such that the function of the fitness equipment is too simple. For example, the fitness equipment such as the bicycle can only exercise the calf muscle and cannot exercise abdomen or arms muscle. Moreover, a rolling wheel for exercising the abdomen muscle cannot exercise arms or legs muscle. The function of the muscle exercise for the user is limited and monotonous.

SUMMARY OF THE INVENTION

An objective of the present invention is to resolve a shortcoming that exercise functions in conventional fitness equipment are too simple. The user can only exercise specific muscle in the conventional equipment and cannot implement the fitness equipment widely. Therefore, the muscle training for the user is limited and monotonous.

In order to achieve the aforementioned purpose in the present invention, a sit-up bench apparatus is disclosed in the present invention and includes:

- a base set including:
  - a seat body having a shaft protruded and formed at a central area on a top surface of the seat body; and
  - a pivotal base having:
    - a sleeving portion protruded and formed at a central area on a bottom surface of the pivotal base, and the shaft of the seat body disposed within the sleeving portion; and
    - an aperture formed at the pivotal base;
- two supporting rod sets respectively and pivotally disposed at two sides of one end of the pivotal base, and each of the two supporting rod sets including:
  - a supporting rod, and one end of the supporting rod pivotally disposed at the pivotal base of the base set; and
  - a first cylinder connected with another end of the supporting rod;
- two elastic sets respectively disposed at the two sides of the end of the pivotal base and connected between the two supporting rod sets and the base set, and each of the two elastic sets including:
  - a spring having two opposite ends, one of the ends of the spring coupled to the end of the supporting rod, and the other end of the spring coupled to the pivotal base; and
- an extending rod set disposed in the aperture of the pivotal base and including:
  - a supporting wheel disposed at one end of the extending rod set and another end of the extending rod set being extendable relative to the pivotal base.

The advantage of the present invention is to implement the supporting rod of the supporting rod sets at the pivotal base of the base set cooperated with the spring of the elastic set. When the user operates the sit-up bench apparatus, the body or the legs of the user can abut on the first cylinder to do muscle exercises such as push-up, stepping training, legs lifting, and so on with the assistance of the elastic force of the spring. When one motion is completed, the spring will move the supporting rod back to the original position. In addition, because of the installation of the extending rod set in the present invention, the extending rod set can be extend and retract relative to the pivotal base and swing relative to the seat body with the pivotal base. Therefore, the user can exercise the muscle at abdomen. When the user performs the muscle exercise, the choices provided by the sit-up bench apparatus of the present invention are diverse and different.

DETAILED DESCRIPTION OF THE PREFERRED EMBODIMENT

These and other aspects of the embodiments herein will be better appreciated and understood when considered in conjunction with the following description and the accompanying drawings.

Figure 1:
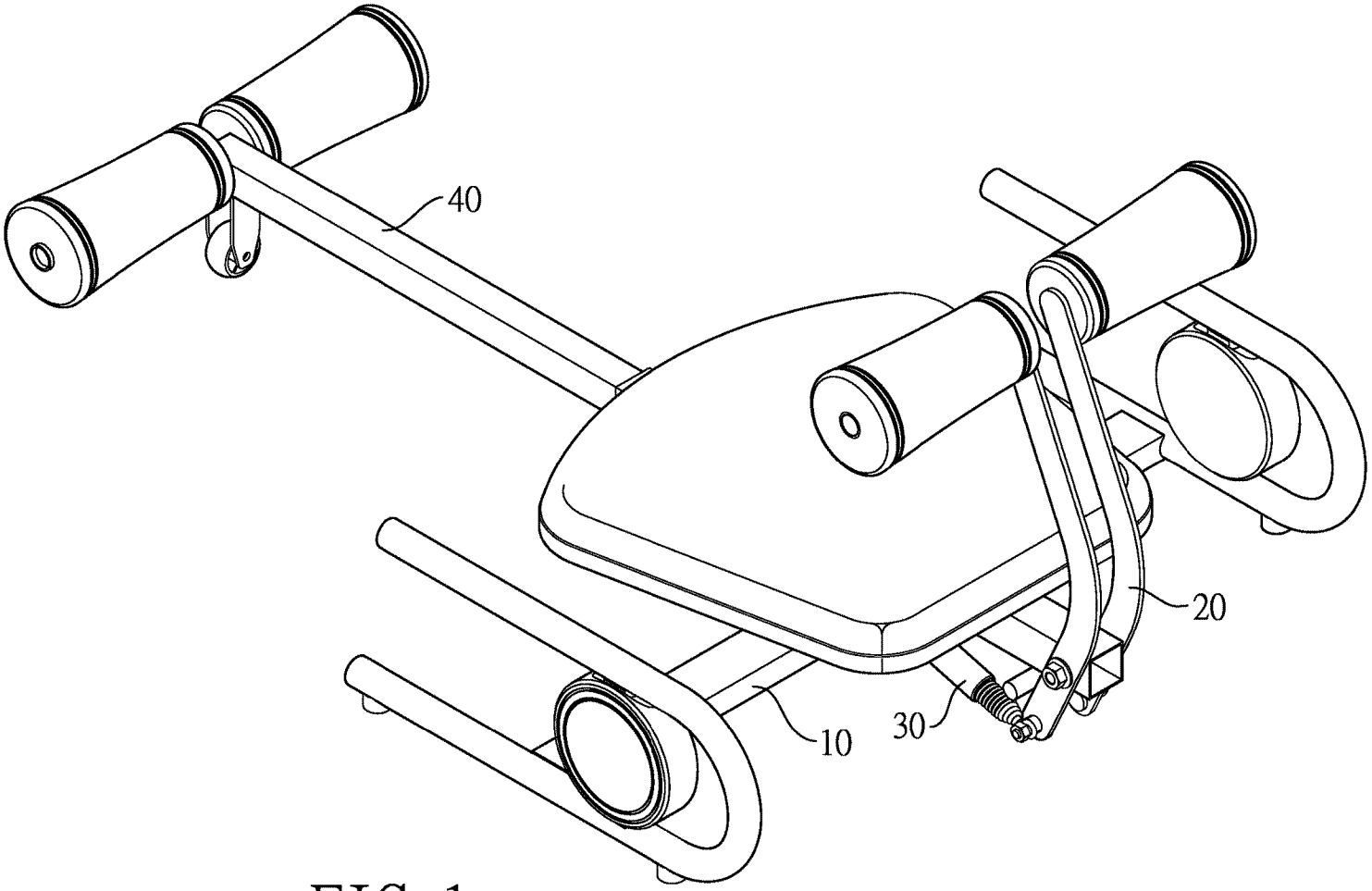
FIG. 1 is a perspective view in the present invention.

With reference to FIG. 1, a set-up bench apparatus in the present invention includes a base set 10, two supporting rod sets 20, two elastic sets 30, and an extending rod set 40.

Figure 2:
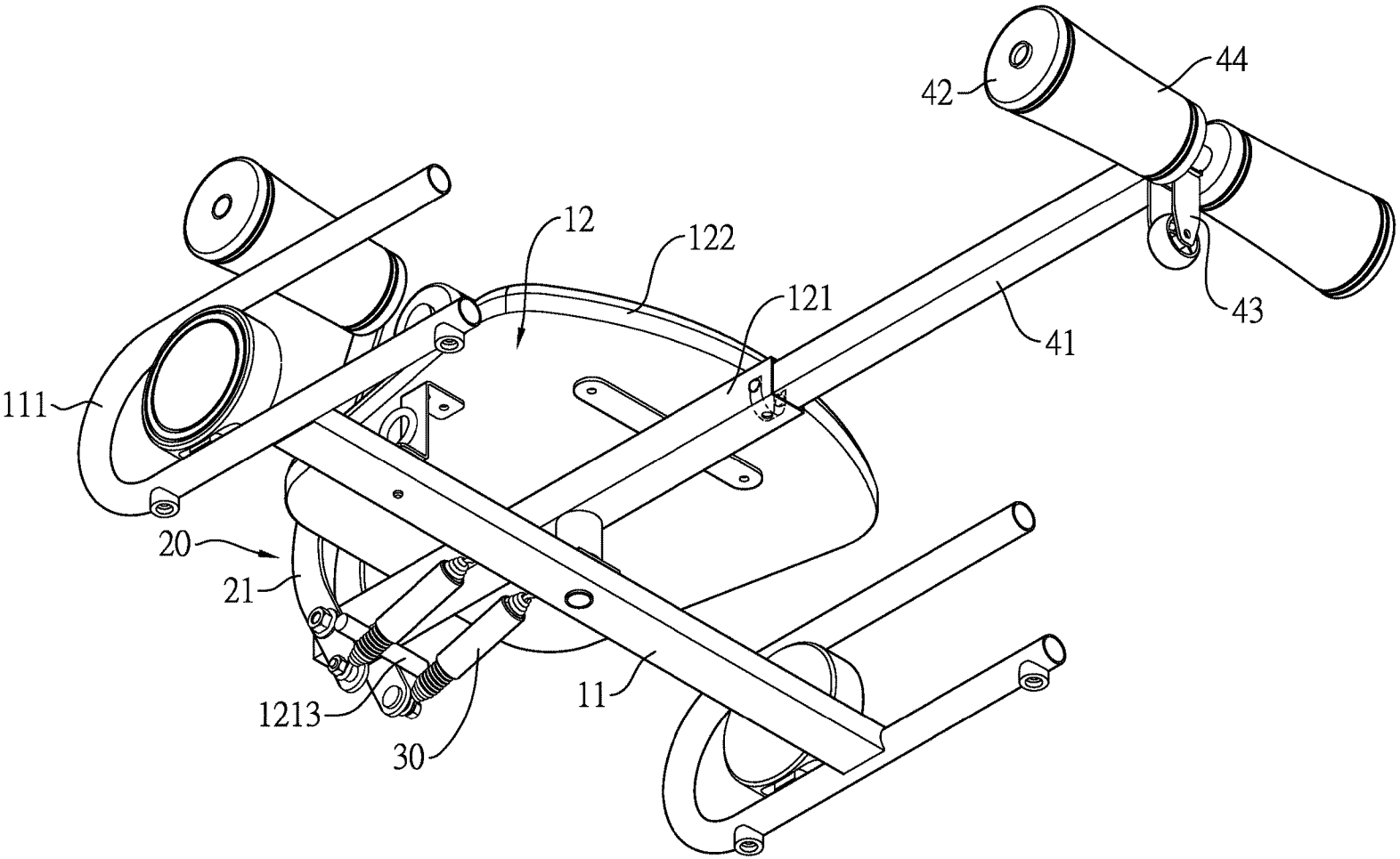
FIG. 2 is another perspective view in the present invention.
Figure 4:
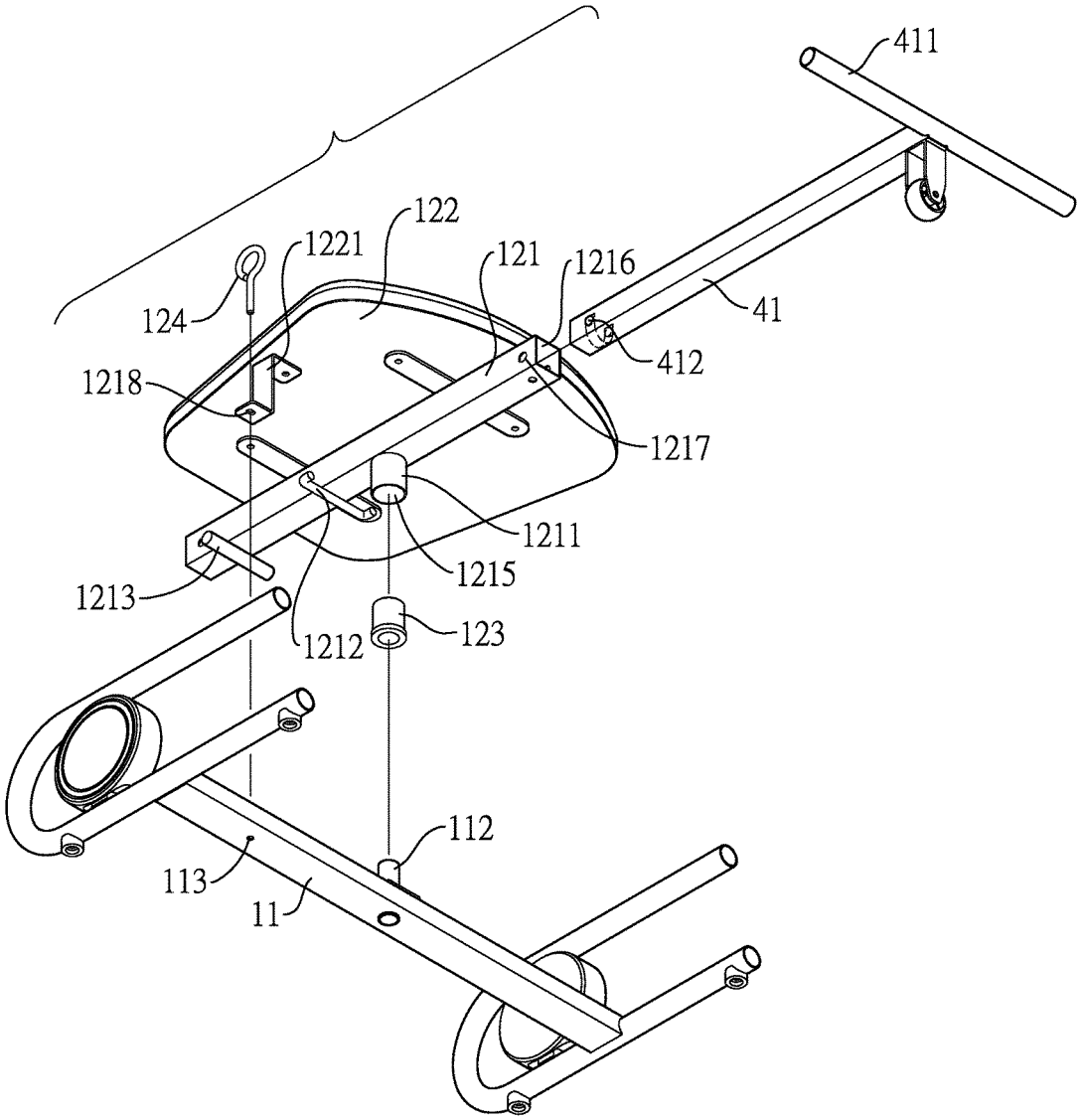
FIG. 4 is an explored view of a base set in the present invention.

With reference to FIG. 2 and FIG. 4, the base set 10 includes a seat body 11 and a pivotal base 12.

The seat body 11 includes two lateral frames 111, a shaft 112, and a fastening hole 113. The two lateral frames 111 are respectively formed at two opposite ends of the seat body 11. The shaft 112 is protruded and formed at a central area on a top surface of the seat body 11. The fastening hole 113 is formed through the seat body 11.

The pivotal base 12 includes a main lever 121, a cushion 122, an axle sleeve 123, and a fastening bolt 124. The main lever 121 has an elongated body and includes a sleeving portion 1211, a sleeving rod 1212, a stopper rod 1213, a fastening axle 1214, a recess 1215, an aperture 1216, and two limiting holes 1217.

The sleeving portion 1211 is protruded and formed at a central area on a bottom surface of the main lever 121. The recess 1215 is formed at the central area of the sleeving portion 1211. The aperture 1216 is formed along a long axle of the main lever 121 and through the main lever 121. The two limiting holes 1217 are respectively formed through the main lever 121 and formed on two opposite lateral surfaces at one end of the main lever 121.

The sleeving rod 1212 and the stopper rod 1213 are disposed at a bottom surface at another end of the main lever 121 and the sleeving rod 1212 is spaced apart from the stopper rod 1213. The sleeving rod 1212 and the stopper rod 1213 are perpendicular to a long axle of the main lever 121.

The fastening axle 1214 passes through and is disposed at one end of the main lever 121 that is close to the positioning axle sleeve 20. The fastening axle 1214 is protruded from the two opposite lateral surfaces of the main lever 121.

The cushion 122 includes a fastening sheet 1221. The fastening sheet 1221 includes a connecting through hole 1218. The cushion 122 is connected at a top surface of the main lever 121. A position of the connecting through hole 1218 of the fastening sheet 1221 corresponds to a position of the fastening hole 113 of the seat body 11. The fastening bolt 124 passes through the connecting through hole 1218 of the fastening sheet 1221 and the fastening hole 113.

The axle sleeve 123 is disposed within the recess 1215. The shaft 112 is inserted in the axle sleeve 123. In other words, the shaft 112 is mounted in the recess 1215 via the axle sleeve 123.

The two supporting rod sets 20 are respectively and pivotally disposed on two sides at one end of the pivotal base 12, as shown in FIG. 1.

Figure 3:
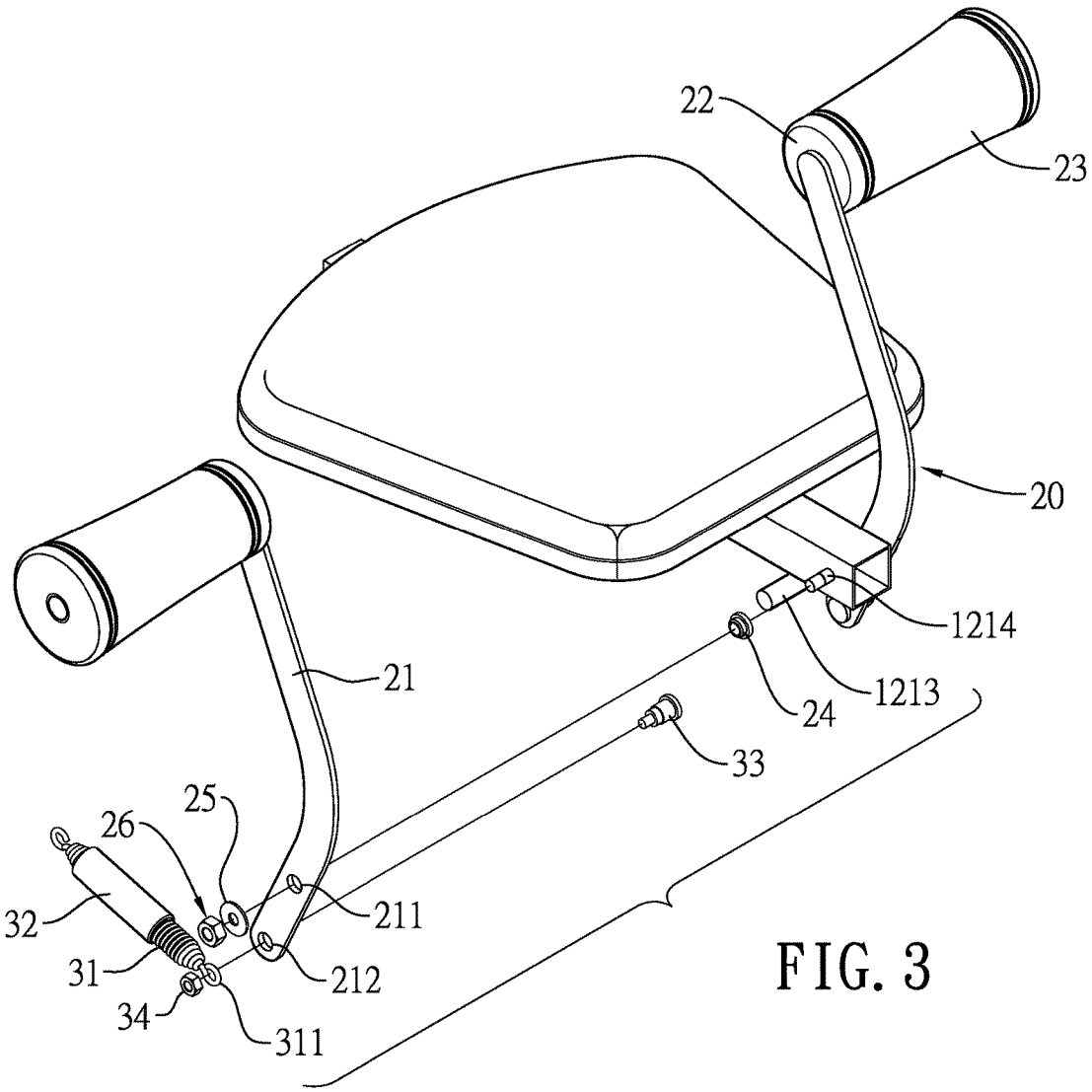
FIG. 3 is an exploded view of two supporting rod sets in the present invention.

With reference to FIG. 3, each of the two supporting rod sets 20 includes a supporting rod 21, a first cylinder 22, a first foam sleeve 23, a positioning axle sleeve 24, a gasket 25, and a first screw nut 26.

The supporting rod 21 has an elongated body and includes a first through hole 211 and a second through hole 212. The first through hole 211 and the second through hole 212 are formed through a lower end of the supporting rod 21. The first through hole 211 is spaced apart from the second through hole 212.

The first cylinder 22 is connected with an upper end of the supporting rod 21 and an axle direction of the first cylinder 22 is perpendicular to a long axle direction of the supporting rod 21.

The first foam sleeve 23 is mounted around an outer lateral surface of the first cylinder 22.

An opening is formed at a central area of the positioning axle sleeve 24. One end of the positioning axle sleeve 24 forms a protruding end in a stepped shape. The positioning axle sleeve 24 is mounted around the fastening axle 1214 of the main lever 121. The protruding end of the positioning axle sleeve 24 passes through the first through hole 211 of the supporting rod 21. The fastening axle 1214 passes through the opening of the positioning axle sleeve 24 and the gasket 25. The gasket 25 abuts on the supporting rod 21. The fastening axle 1214 is connected with the first screw nut 26 and protrudes from the positioning axle sleeve 24 and the gasket 25. The gasket 25 abuts on the supporting rod 21. The first screw nut 26 is connected with one end of the fastening axle 1214 that passes through and protrudes from the positioning axle sleeve 24 and the gasket 25.

The two elastic sets 30 are respectively disposed at two sides of one end of the pivotal base 12 and connected between the supporting rod 20 and the base set 10, as shown in FIG. 2.

With reference to FIG. 3, each of the two elastic sets 30 includes a spring 31, a casing 32, a fastener 33, and a second screw nut 34.

Each one of two opposite ends of the spring 31 includes a collar 311. The collar 311 at one end of the spring 31 is mounted around the sleeving rod 1212 of the main lever 121.

The casing 32 is mounted around the outer lateral surface of the spring 31.

The fastener 33 passes through the second through hole 212 of the supporting rod 21 and the collar 311 at the other end of the spring 31. The second screw nut 34 is connected with the fastener 33 and the fastener 33 passes through the second through hole 212 and the collar 311. Therefore, the supporting rod 21 abuts on the stopper rod 1213 of the main lever 121 by elastic force of the spring 31.

With reference to FIG. 2 and FIG. 4, the extending rod set 40 includes a rod component 41, two second cylinders 42, a supporting wheel 43 and two second foam sleeves 44.

The rod component 41 has an elongated body and includes a mounting portion 411 and a bump 412. The mounting portion 411 is formed at one end of the rod component 41 and is perpendicular to a long axle direction of the rod component 41. The bump 412 is disposed on an inner lateral surface at another end of the rod component 41. The bump 412 is an elastic component that is bent and two ends of the elastic component face outward. The bump 412 is a conventional art and the detailed description of the bump 412 is omitted herein.

The two second cylinders 42 are respectively disposed at two opposite ends of the mounting portion 411. The two second cylinders 42 are hollow cylinders and include hollow portions respectively. The hollow portion of the second cylinder 42 is coupled to the mounting portion 411. An axle direction of the second cylinder 42 is perpendicular to a long axle direction of the rod component 41. The supporting wheel 43 is disposed at a bottom surface of the rod component 41 and close to the two second cylinders 44. The end of the rod component 41 for disposing the bump 412 is installed within the aperture 1216 of the main lever 121 of the pivotal base 12 and can be moved back and forth relative to the pivotal base 12. The end of the bump 412 can be fastened within the limiting hole 1217 to prevent the rod component 41 from completely releasing from the main lever 121 when the rod component 41 extends The second foam sleeve 44 is mounted around an outer lateral surface of the second cylinder 42.

Figure 5:
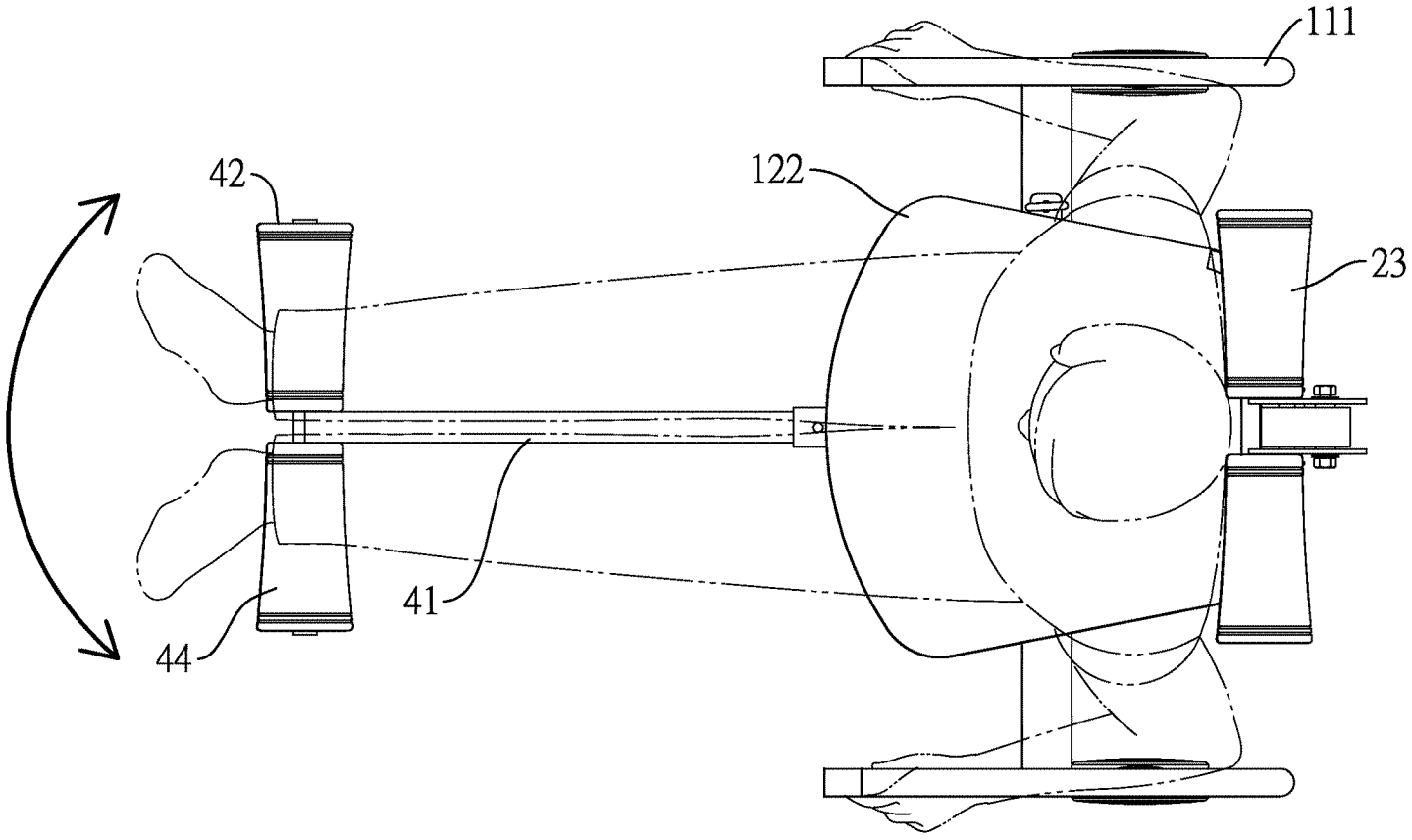
FIG. 5 is a top view in a first operational view of the present invention.

With reference to FIG. 2 and FIG. 5, in a first operational view of the present invention, after the user pulls the rod component 41 from the main lever 121, the user sits on the cushion 122 and two feet of the user step on the second foam sleeve 44 of the second cylinder 42. Then, two hands of the user hold the two lateral frames 111 to perform a swing motion by two feet, and the cushion 122 may be pivoted relative to the seat body 11. Therefore, a waist of the user can twist left and right to exercise waist muscle. Before the user operates at the first operational view of the present invention, the fastening bolt 124 has to be removed from the fastening sheet 1221 of the cushion 122, as shown in FIG. 4. Therefore, the pivotal seat 12 may be pivotally moved relative to the seat body 11.

Figure 6:
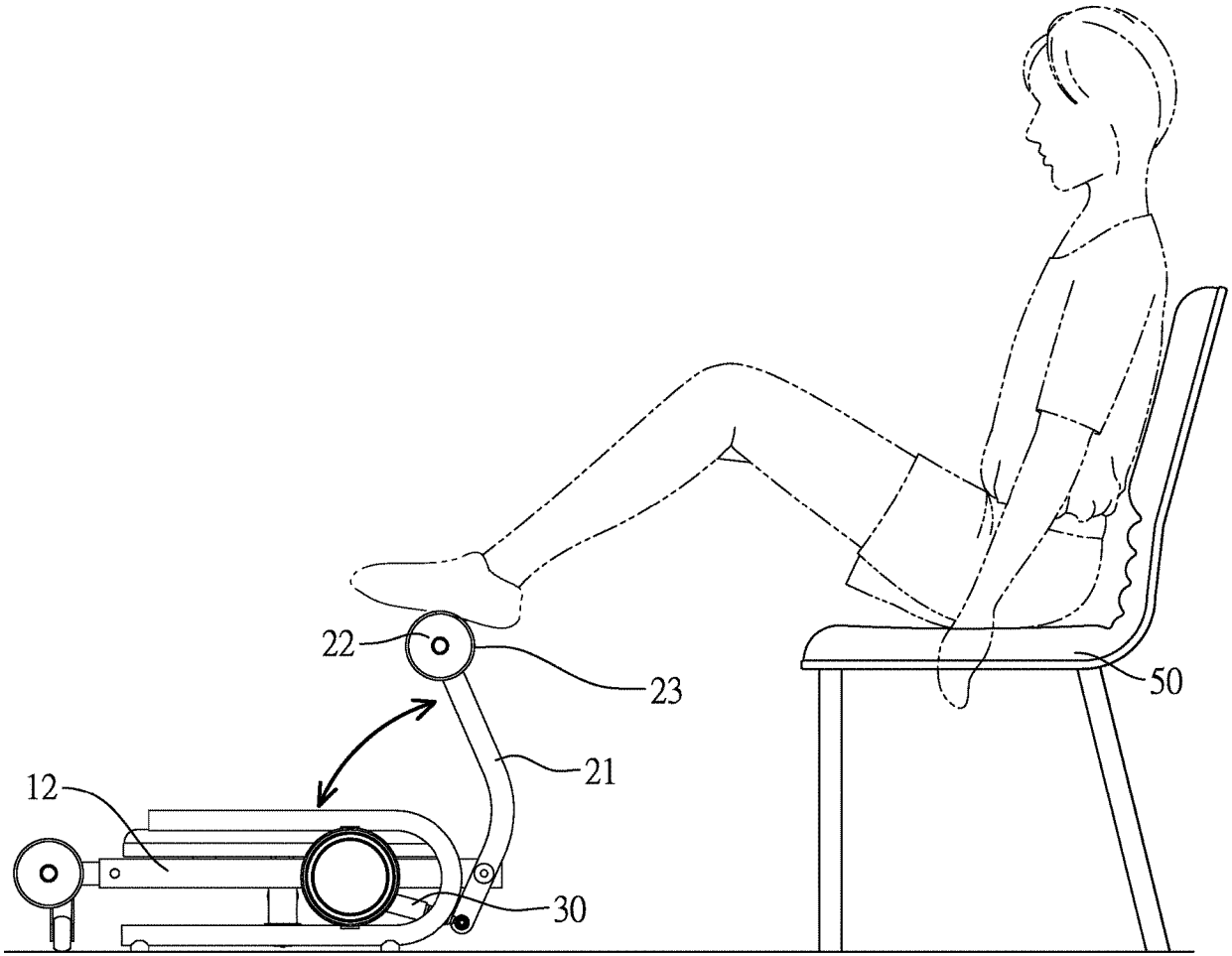
FIG. 6 is a lateral view in a second operational view of the present invention.

FIG. 6 shows a second operational view of the present invention. With reference to FIG. 6, the user sits on a chair 50 and two feet respectively step on the first foam sleeves 23 of the two first cylinders 22. When the two feet step down, the two first cylinders 22 move backward along the direction of the pivotal base 12 and the two feet can perform a back and forth movement at the same time to exercise legs muscle. The elastic force generated by the elastic sets 30 may help the user to move back to the original position. Before performing a second to a fifth operational view in the present invention, the user has to plug the fastening bolt 124 into the fastening sheet 1221 and the fastening hole 113 to make sure that the pivotal base 12 will not move relative to the seat body 11 during the exercise movement.

Figure 7:
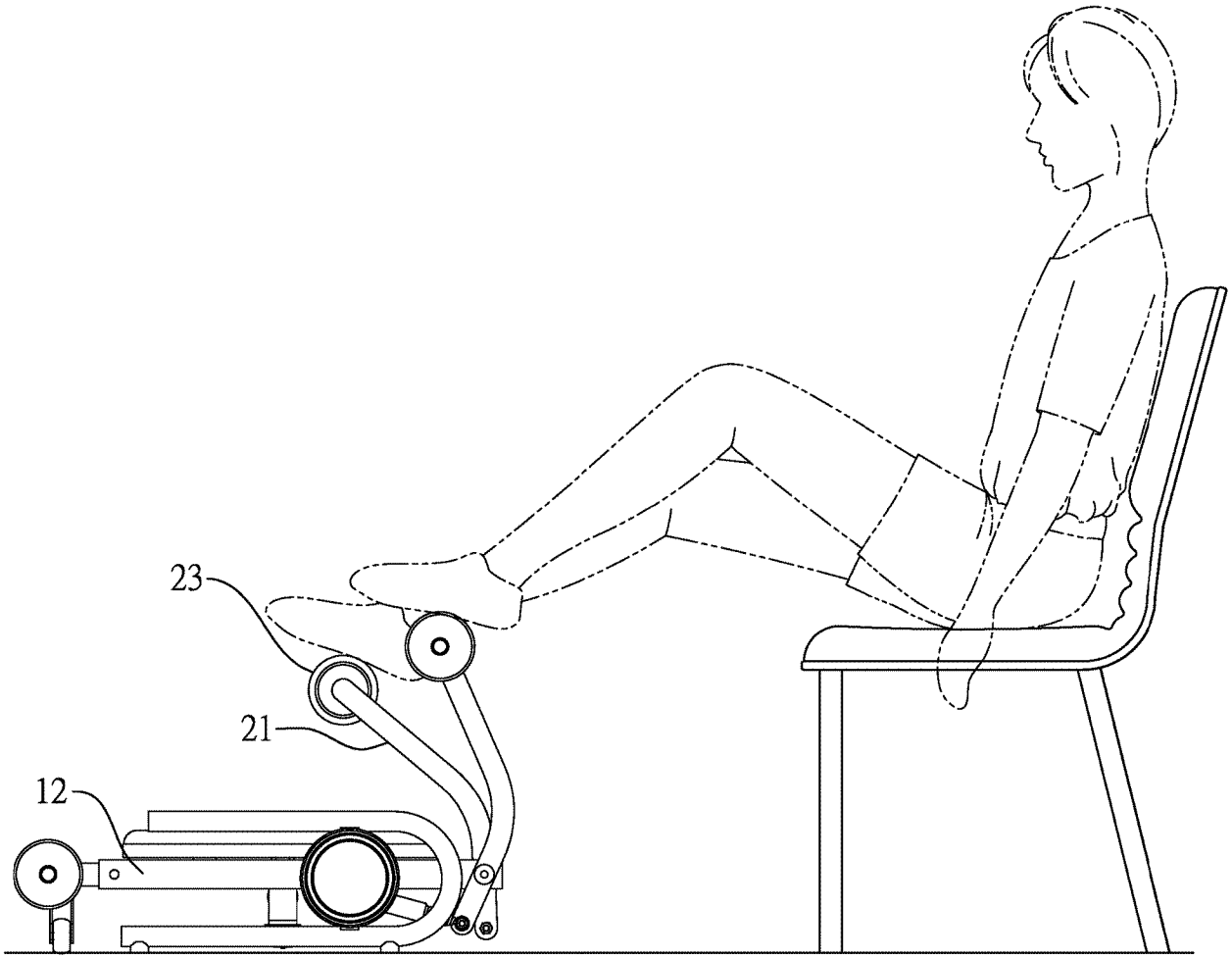
FIG. 7 is a lateral view in a third operational view of the present invention.

FIG. 7 shows a third operational view of the present invention. Since the two supporting rod sets 20 are respectively and pivotally disposed at two sides of the main lever 121 as shown in FIG. 2, the two feet of the user can respectively and alternately step on the first foam sleeves 23 of the two first cylinders 22. The stepping movement of the two feet can be alternately performed and calf muscle of the two feet can be exercised in a biking way.

Figure 8:
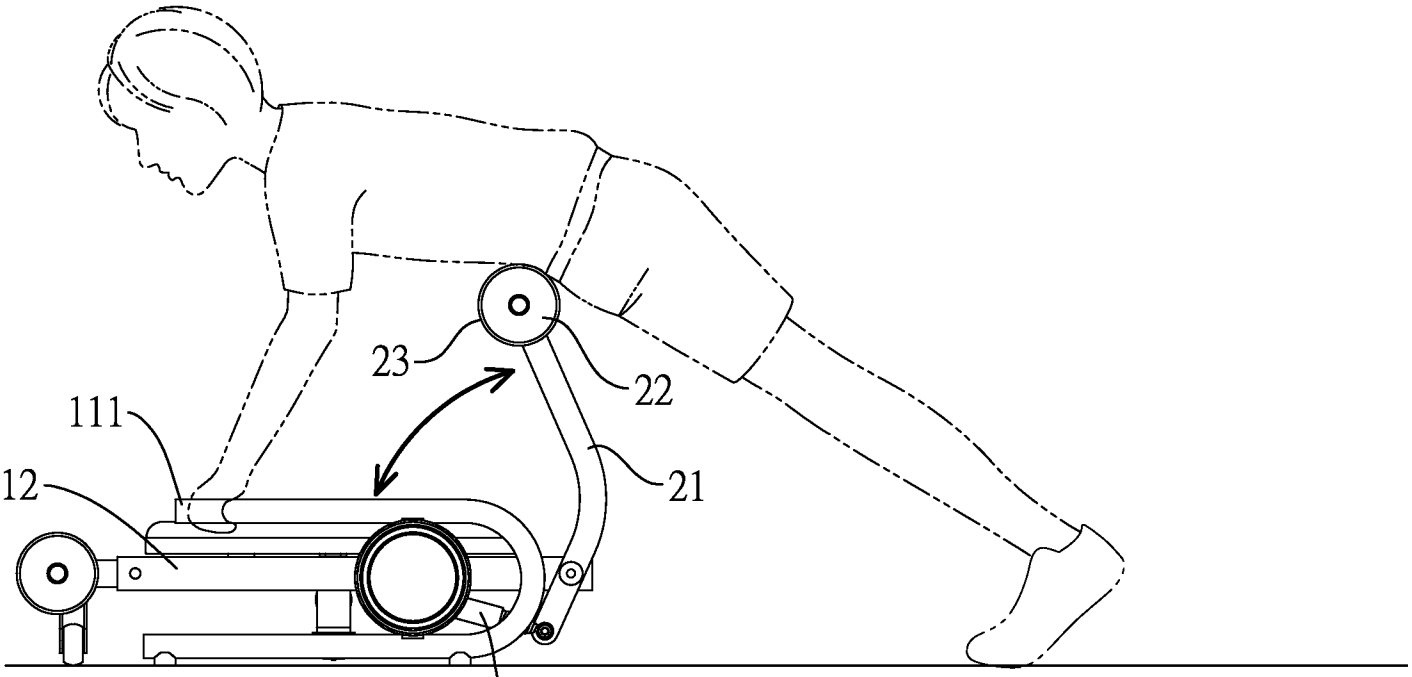
FIG. 8 is a lateral view in a fourth operational view of the present invention.

FIG. 8 shows a fourth operational view of the present invention. When the user will perform push-ups to develop an arm muscular strength, an abdomen of the user abuts on the first foam sleeve 23 of the first cylinder 22 and two hands respectively hold the lateral frames 111 to perform a push down movement of the two arms. During the exercise, the supporting rod 21 will be pushed down to the pivotal base 12 along the first cylinder 22. When the arms of the user move straight, the elastic force of the elastic set 30 on the supporting rod 21 will help the user to move back to the original position of the movement so as to prevent the muscle getting injured because of over pushing.

Figure 9:
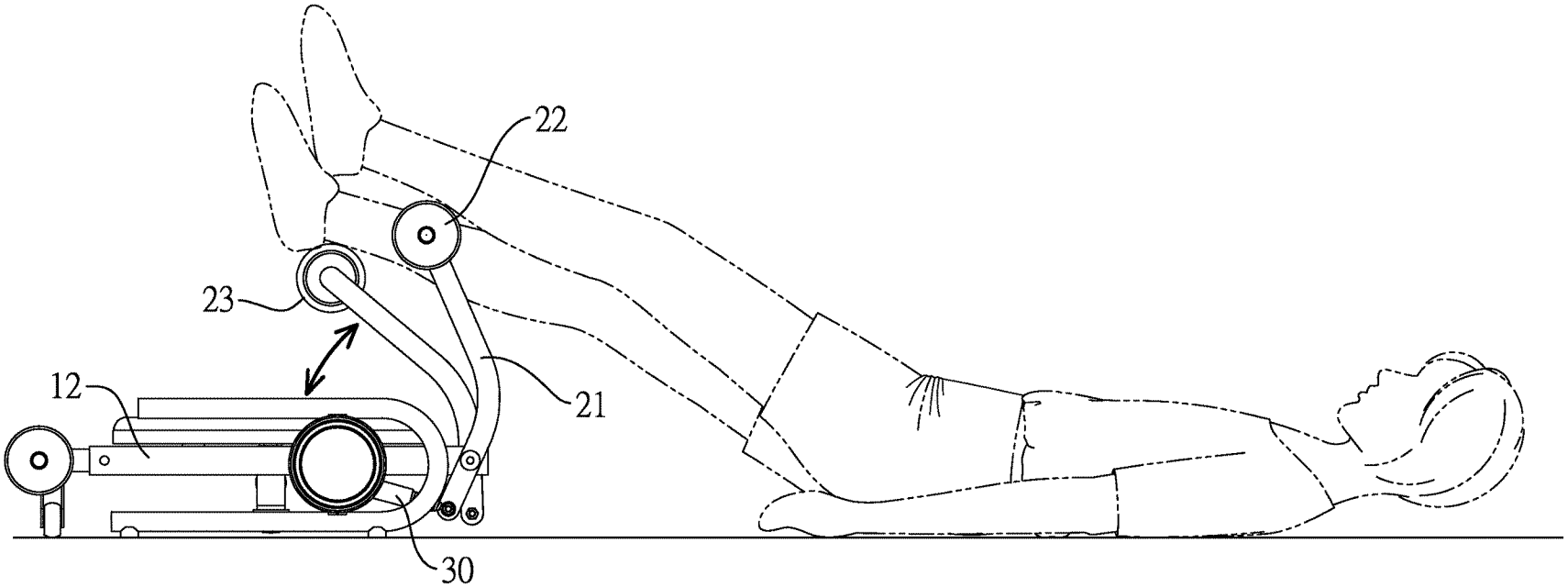
FIG. 9 is a lateral view in a fifth operational view of the present invention.

FIG. 9 is the fifth operational view of the present invention. When the user lies on the ground, shin portions of the two feet are put on the first foam sleeve 23 of the first cylinder 22 and push down to force the supporting rod 21 to move downward along the direction of the pivotal base 12. The elastic force of the elastic sets 30 will move the supporting rod 21 back to the original position and the user can move the legs upward to strengthen the muscles on the abdomen, thighs and buttocks. Since the two supporting rods 20 are respectively disposed on two sides of the main lever 121 in the present invention as shown in FIG. 2, the pushing movement on the two feet can be alternately performed. Alternatively, the two feet of the user can push down the first cylinder 22 together to perform the pushing down movement at the same time.

Since the supporting rod 21 of the supporting rod set 20 in the present invention is pivotally disposed at the pivotal base 12 of the base set 10 and the spring 31 of the elastic component 30 is connected between the pivotal base 12 and the supporting rod 21, the body or the legs of the user can abut on the first cylinder 22 when the user operates the sit-up bench apparatus. Muscle exercise such as push-ups, stepping training, legs lifting, and so on can be performed by the assistance of the elastic force of the spring 31. After the exercise is performed, the spring 31 will move the supporting rod 21 back to the original position. At the mean time, the extending rod set 40 can extend and swing relative to the seat body 11 in accordance with the pivotal base 12, and it is convenient for the user to perform the exercise for the abdomen. When the user performs the muscle exercise, the options are diverse and varied.

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A sit-up bench apparatus comprising:

a base set including:

a seat body having a shaft protruded and formed at a central area on a top surface of the seat body; and a pivotal base having:

a sleeving portion protruded and formed at a central area on a bottom surface of the pivotal base, and the shaft of the seat body disposed within the sleeving portion; and an aperture formed at the pivotal base;

two supporting rod sets respectively and pivotally disposed at two sides of one end of the pivotal base, and each of the two supporting rod sets including:

a supporting rod, and one end of the supporting rod pivotally disposed at the pivotal base of the base set; and a first cylinder connected with another end of the supporting rod;

two elastic sets respectively disposed at the two sides of the end of the pivotal base and connected between the two supporting rod sets and the base set, and each of the two elastic sets including:

a spring having two opposite ends, one of the ends of the spring coupled toy the end of the supporting rod, and the other end of the spring coupled to the pivotal base; and an extending rod set disposed in the aperture of the pivotal base and including:

a supporting wheel disposed at one end of the extending rod set and another end of the extending rod set being extendable relative to the pivotal base, whereby when a user operates the sit-up bench apparatus, a body or legs of the user abut the first cylinder of the supporting rod set cooperated with the elastic set to perform push-up, stepping and legs lifting training, and by the extending rod set, an abdominal muscle training is performed.

2. The sit-up bench apparatus as claimed in claim 1, wherein the seat body further includes:

two lateral frames respectively formed at two opposite ends of the seat body; and a fastening hole formed through the seat body.

3. The sit-up bench apparatus as claimed in claim 2, wherein the pivotal base further includes:

a main lever having an elongated body, wherein the sleeving portion is formed on a bottom surface of the main lever and the aperture is formed along a long axle of the main lever and through the main lever, and the main lever includes:

a fastening axle passing through the supporting rod and protruded from two opposite lateral surfaces of the main lever, and the fastening axle is disposed at the main lever; and a sleeving rod and a stopper rod disposed at the bottom surface of the main lever, the stopper rod spaced apart from the sleeving rod, and the sleeving rod and the stopper rod being perpendicular to the long axle of the main lever;

a cushion having a fastening sheet with a connecting through hole, and the cushion connected on a top surface of the main lever;

an axle sleeve disposed within a recess of the sleeving portion and mounted around the shaft of the seat body, and the connecting through hole of the fastening sheet corresponding to the fastening hole of the seat body; and a fastening bolt passing through the connecting through hole of the fastening sheet and the fastening hole, and the supporting rod pivotally disposed at one end of the main lever.

4. The sit-up bench apparatus as claimed in claim 3, wherein one of the two opposite ends of the spring is coupled to the main lever, and the two opposite ends of the spring respectively include a collar, and the collar at said one of the two opposite ends of the spring is mounted around the sleeving rod of the main lever.

5. The sit-up bench apparatus as claimed in claim 4, wherein the extending rod set includes:

a rod component having an elongated body, and the rod component including a mounting portion formed at one end of the supporting wheel and the mounting portion being perpendicular to a long axle direction of the rod component; and two second cylinders respectively connected with two opposite lateral surfaces at one end of the rod component, and an axle direction of the two second cylinders being perpendicular to the long axle direction of the rod component and the supporting wheel installed on a bottom surface of the rod component and close to the two second cylinders, the two second cylinders being hollow cylinders and respectively disposed at two opposite ends of the mounting portion.

6. The sit-up bench apparatus as claimed in claim 5, wherein the supporting rod has an elongated body and the supporting rod includes a first through hole, the first through hole is formed through the end of the main lever, and an axle direction of the first cylinder is perpendicular to a long axle direction of the supporting rod.

7. The sit-up bench apparatus as claimed in claim 6, wherein each of the supporting rod sets further includes:

a positioning axle sleeve, and the positioning axle sleeve including an opening at a central area of the positioning axle sleeve, one end of the positioning axle sleeve being a protruding end in a stepped shape passing through the first through hole of the supporting rod, and the positioning axle sleeve mounted around the fastening axle of the main lever;

a gasket abutting on the supporting rod; and a first screw nut connected with the end of the fastening axle protruded from the positioning axle sleeve and the gasket;

wherein the fastening axle passes through the opening of the positioning axle sleeve and the gasket.

8. The sit-up bench apparatus as claimed in claim 7, wherein the supporting rod further includes a second through hole, the second through hole is formed through the end of the main lever pivotally disposed at the supporting rod, the second through hole is spaced apart from the first through hole, and the supporting rod abuts on the stopper rod of the main lever.

9. The sit-up bench apparatus as claimed in claim 8, wherein each of the two elastic sets further includes:

a casing mounted around an outer lateral surface of the spring;

a fastener passing through the second through hole of the supporting rod and the collar at one of the two opposite ends of the spring; and a second screw nut connected with the second through hole and the collar at one of the two opposite ends of the spring.

10. The sit-up bench apparatus as claimed in claim 9, wherein each of the supporting rod sets further includes a first foam sleeve mounted around an outer lateral surface of the first cylinder, and the extending rod set further includes two second foam sleeves respectively mounted around an outer lateral surface at each of the two second cylinders.

* * * * *